United States Patent [19]

Springfield

[11] Patent Number: 4,898,247

[45] Date of Patent: Feb. 6, 1990

[54] EARTH SCRAPER ATTACHMENT FOR A TRACTOR OR THE LIKE

[76] Inventor: Hendrix W. Springfield, Rte. #2, Box 250-1, Springtown, Tex. 76082

[21] Appl. No.: 25,730

[22] Filed: Mar. 13, 1987

[51] Int. Cl.[4] ..... E02F 3/76

[52] U.S. Cl. ..... 172/799.5; 172/413; 172/477; 172/200

[58] Field of Search ..... 172/799.5, 780, 439, 172/413, 327, 787, 200, 684.5, 784, 785, 780, 477

[56] References Cited

U.S. PATENT DOCUMENTS

| | | | |
|---|---|---|---|
| 1,982,219 | 11/1934 | McAlister | 172/799.5 |
| 2,866,281 | 12/1958 | Breaux | 172/799.5 |
| 3,172,480 | 3/1965 | Bemis | 172/799.5 |
| 3,302,317 | 2/1967 | Domres | 172/799.5 |
| 3,716,105 | 2/1973 | Hallam | 172/447 |
| 3,924,689 | 12/1975 | Manor | 172/799.5 |
| 4,526,238 | 7/1985 | Williams | 172/780 |

FOREIGN PATENT DOCUMENTS

| | | | |
|---|---|---|---|
| 1255959 | 12/1971 | United Kingdom | 172/799.5 |

*Primary Examiner*—Richard J. Johnson

*Attorney, Agent, or Firm*—Hubbard, Thurman, Turner & Tucker

[57] ABSTRACT

An earth scraper attachment adapted to be drawn by a farm tractor or other vehicle having a vertically adjustable three point hitch has an elongated frame with a front tongue portion connectable to the hitch with a specially designed hitch connection member. A rear end portion of the frame is supported on opposite sides of the longitudinal axis of the frame by a pair of wheels whose heights relative to the frame may be selectively and independently adjusted. Depending from a longitudinally central portion of the frame is an earth scraping blade which is supported on the frame for pivotal motion about a generally vertically extending axis, and may be locked in a selected pivotally adjusted position. A laterally spaced series of downwardly extending earth ripping teeth are supported beneath the frame forwardly of the scraping blade and are used to rip and loosen the earth prior to operation thereon by the scraping blade. The independent height adjustment of the rear support wheels, together with the tongue height adjustment provided by the three point hitch, allows various positional adjustments to be made to the frame including uniformly raising or lowering the overall frame, altering its front-to-rear tilt angle and altering its side-to-side tilt angle about the longitudinal frame axis. These frame positional adjustments, coupled with the pivotal adjustment capability of the scraping blade, permit the blade and its associated ripping teeth to be variously positioned to perform most of the sophisticated earth-scraping and grading functions of heavy duty commercial apparatus, such as motor graders, at a fraction of the cost thereof.

6 Claims, 5 Drawing Sheets

EARTH SCRAPER ATTACHMENT FOR A TRACTOR OR THE LIKE

BACKGROUND OF THE INVENTION

The present invention relates generally to earth working apparatus, and more particularly provides a uniquely adjustable earth scraper attachment connectable to the three point hitch of a farm tractor or the like to perform various earth scraping and grading functions when pulled behind the tractor.

Large scale earth scraping and grading operations, such as those used in the construction of a road or highway, are typically performed by utilizing a very large and very expensive device commonly known as a "motor grader". Commercial motor graders typically include an operator-controlled motor driven vehicle which has secured thereto a large, wheel-supported, fixed position frame. Supported beneath the frame is an earth scraping blade which is adapted to engage, scrape and grade the surface of the earth as the vehicle and its frame are slowly moved along the ground. The vertical position, and a variety of angular orientations, of the scraping blade relative to the fixed position frame are selectively adjustable by a rather sophisticated hydraulic control system by which the blade may be selectively moved relative to the fixed frame. In this manner the scraping depth of the blade, the side-to-side angle of its scraping pattern, and its front-to-rear earth scraping attack angle may be selectively and independently adjusted.

While such conventional motor graders are well suited to highway construction grading and other heavy duty earth leveling applications, their great bulk and high cost in many instances preclude their use in smaller scale domestic earth working applications such as, for example, the grading and recontouring of farm land soil.

At the other end of the motorized earth-scraping and grading spectrum are small earth scraping attachments which are connectable to farm tractors and the like. These conventional earth scraping attachments, which are connectable at a forward end portion to the tractor's three point hitch, typically comprise a wheel-supported frame to which is rigidly connected an earth scraping blade. The fixed position blade may be raised or lowered by raising or lowering the three point hitch.

While this conventional tractor attachment is suitable for a variety of relatively simple earth scraping operations, it has nowhere near the operational flexibility provided by the much larger and more expensive motor grader. Specifically, the scraping blade of the conventional tractor-drawn grading attachment can only be raised or lowered. It cannot be pivoted to vary the attack angle of the scraping blade, and it cannot be tilted to provide an angled earth scraping pattern. In short, such conventional tractor-drawn earth scraping attachments fall far short of the sophistication and operational usefulness of commercial motor graders.

It can accordingly be seen that a need exists for a relatively inexpensive earth scraping apparatus which can more closely approximate the various earth scraping and grading functions, for smaller scale domestic operations, of the commercial motor grader. It is thus an object of the present invention to provide such apparatus.

SUMMARY OF THE INVENTION

In carrying out principles of the present invention, in accordance with a preferred embodiment thereof, a substantially improved tractor-drawn earth scraper attachment is provided which may be fabricated for a very small fraction of the cost of a conventional commercial motor grader. Despite the low fabrication cost of the earth scraper attachment of the present invention, the positional adjustment capability of its earth scraping blade portion at least closely approximates that of a commercial motor grader. Importantly, however, the blade adjustment capability of such attachment, which permits the blade to be lowered, raised tilted and pivoted relative to the earth, is uniquely achieved without the necessity of providing the complex and costly hydraulic blade positioning control system associated with motor graders.

In a preferred embodiment thereof, the earth scraper attachment of the present invention includes an elongated frame which has front and rear end portions spaced apart along the longitudinal axis of the frame, a pair of side portions positioned on opposite sides of the longitudinal axis, and a pair of support wheels connected to the rear end of the frame on opposite sides of the longitudinal axis.

An elongated earth scraping blade is operatively supported beneath a longitudinally intermediate portion of the frame by means of a frame support structure which is connected to the frame for pivotal motion relative thereto about a generally vertically extending axis. The frame support structure may either be mechanically or manually pivoted about such vertically extending axis, and suitable locking means are provided for locking the scraping blade in a selected pivotally adjusted position. This simple pivotally adjustable connection of the scraping blade to the frame permits the scraping attack angle of the blade to be easily and quickly adjusted.

An elongated, laterally extending support member is secured to the frame forwardly of the cutting blade and has removably secured thereto a spaced series of downwardly extending ripping teeth. As the scraper attachment is forwardly pulled along the ground by the tractor, these ripping teeth function to break up and loosen the earth to facilitate the scraping function of the scraping blade which follows the ripping teeth.

The front end of the attachment frame is connected to the tractor's three point hitch by a specially designed hitch connection member which has a generally triangular configuration. The outer ends of the three pivot arms of the tractor hitch are each pivotally connected to one of the three corners of the hitch connection member. A horizontally extending base portion of the hitch connection member has secured thereto a hitch ball which is insertable into a corresponding socket fitting secured to the front end of the attachment frame. By raising or lowering the three point hitch, the attachment frame is caused to pivot about its rear support wheels to vertically adjust the front end of the frame and correspondingly raise or lower the earth scraping blade and its associated ripping teeth positioned forwardly thereof.

The rear frame support wheels are connected to the outer ends of a pair of wheel support arms which are pivoted at their inner ends to opposite rear corner portions of the frame. A pair of hydraulically operated pistons and associated actuating rods are interconnected between the frame and these wheel support arms and are powered by the tractor's auxiliary hydraulic drive system via suitable hydraulic supply and return line interconnected between such drive system and the hydraulic cylinders. The hydraulic cylinders may be suitably driven to pivot the wheel support arms to thereby cause the selective and independent raising or lowering of each of the support wheels relative to the frame. This independent wheel height adjustment capability permits selective raising or lowering of the rear end of the frame and/or selective tilting of the frame in a side-to-side fashion about its longitudinal axis. The wheel height adjustment, and the front frame end adjustment provided by the tractor's three point hitch, permit the orientation of the frame relative to the earth to be selectively adjusted in a variety of manners including uniformly raising or lowering of the overall frame, adjusting the forward-to-rear tilt angle of the frame, and adjusting the side-to-side tilt angle of the frame about its longitudinal axis.

These independent frame adjustment capabilities, coupled with the simple pivotal adjustment of the scraping blade relative to the frame, provide the blade (and, to a lesser extent, its associated ripping teeth) with essentially all of the adjustment capabilities of the scraping blade carried by a commercial motor grader.

Specifically, raising or lowering the frame simultaneously adjusts the cutting depths of the ripping teeth and the scraping blade as the attachment is being pulled along by the tractor. Forward or rearward tilting of the frame can be used to selectively adjust the relative cutting depths of the teeth and the blade. Side-to-side tilting of the frame about its longitudinal axis correspondingly tilts the scraping blade and the ripping teeth to provide an angled scraping and grading pattern on the earth. Finally, by simply pivotally adjusting the scraping blade relative to the frame, the scraping attack angle of the blade may be easily and selectively varied.

From the foregoing it can be seen that the earth scraper attachment of the present invention is uniquely and simply adjustable to provide its earth working components with positional flexibility closely comparable to those found in commercial motor graders. Specifically, the scraping blade of the attachment, and the associated ripping teeth, may be raised, lowered, or tilted from side to side. Additionally, the earth scraping attack angle of the scraping blade may be selectively adjusted simply by pivoting the mechanical blade support structure relative to the frame. Importantly, these various positional adjustments to the scraping components of the tractor-drawn attachment (with the exception of the adjustment in scraping blade attack angle) are achieved simply by reorienting the attachment frame relative to the earth instead of utilizing a more complicated and costly hydraulic control system to raise, lower, pivot and tilt the earth working components of the attachment relative to the frame.

Accordingly, the relatively low cost of the attachment permits it to be economically used to perform most motor grader earth working functions in a variety of domestic and agricultural applications.

DETAILED DESCRIPTION

Figure 1:
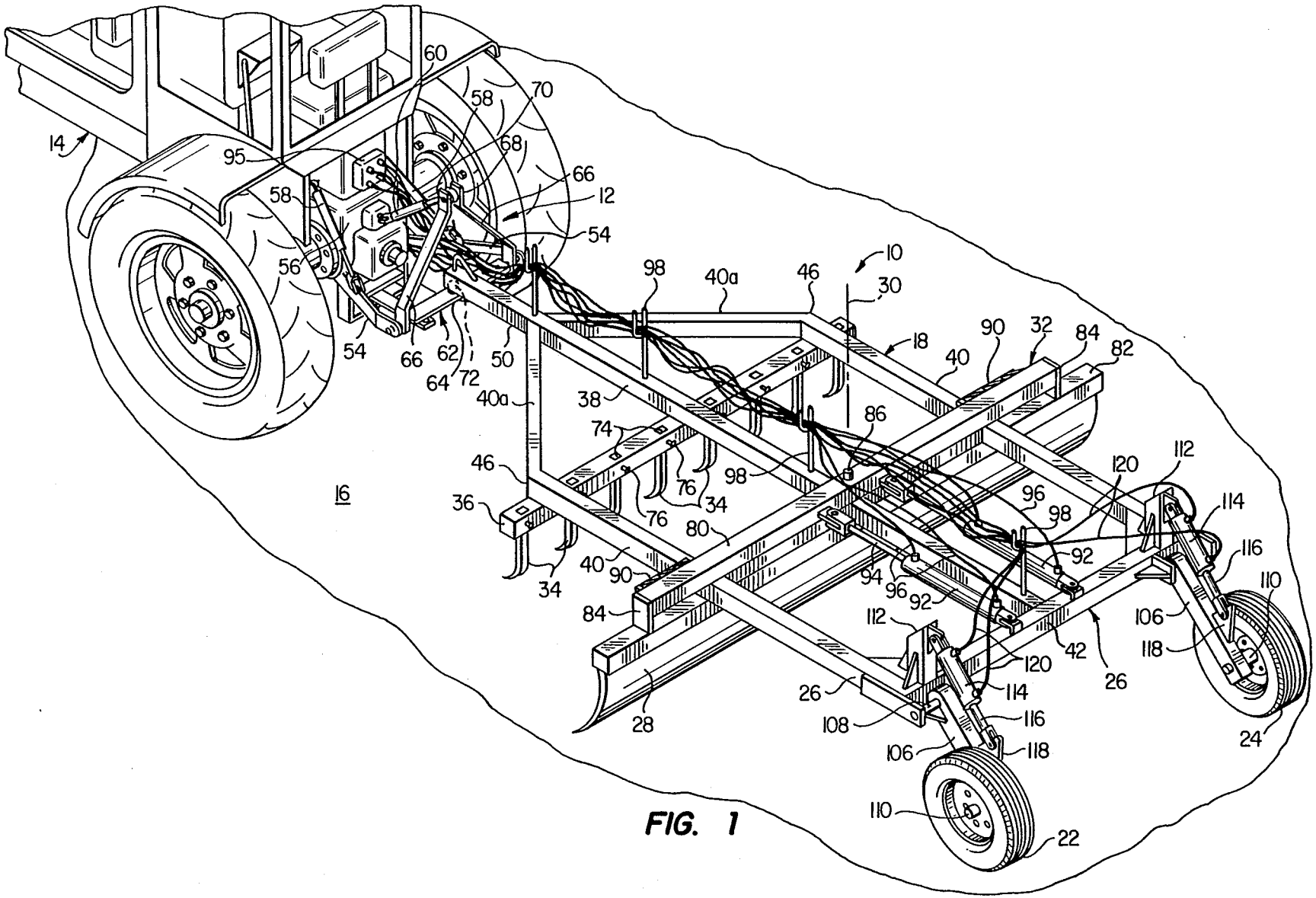
FIG. 1 is a rear perspective view of an earth scraper attachment of the present invention operatively connected to the vertically adjustable three point hitch disposed at the rear of a conventional farm tractor.
Figure 2:
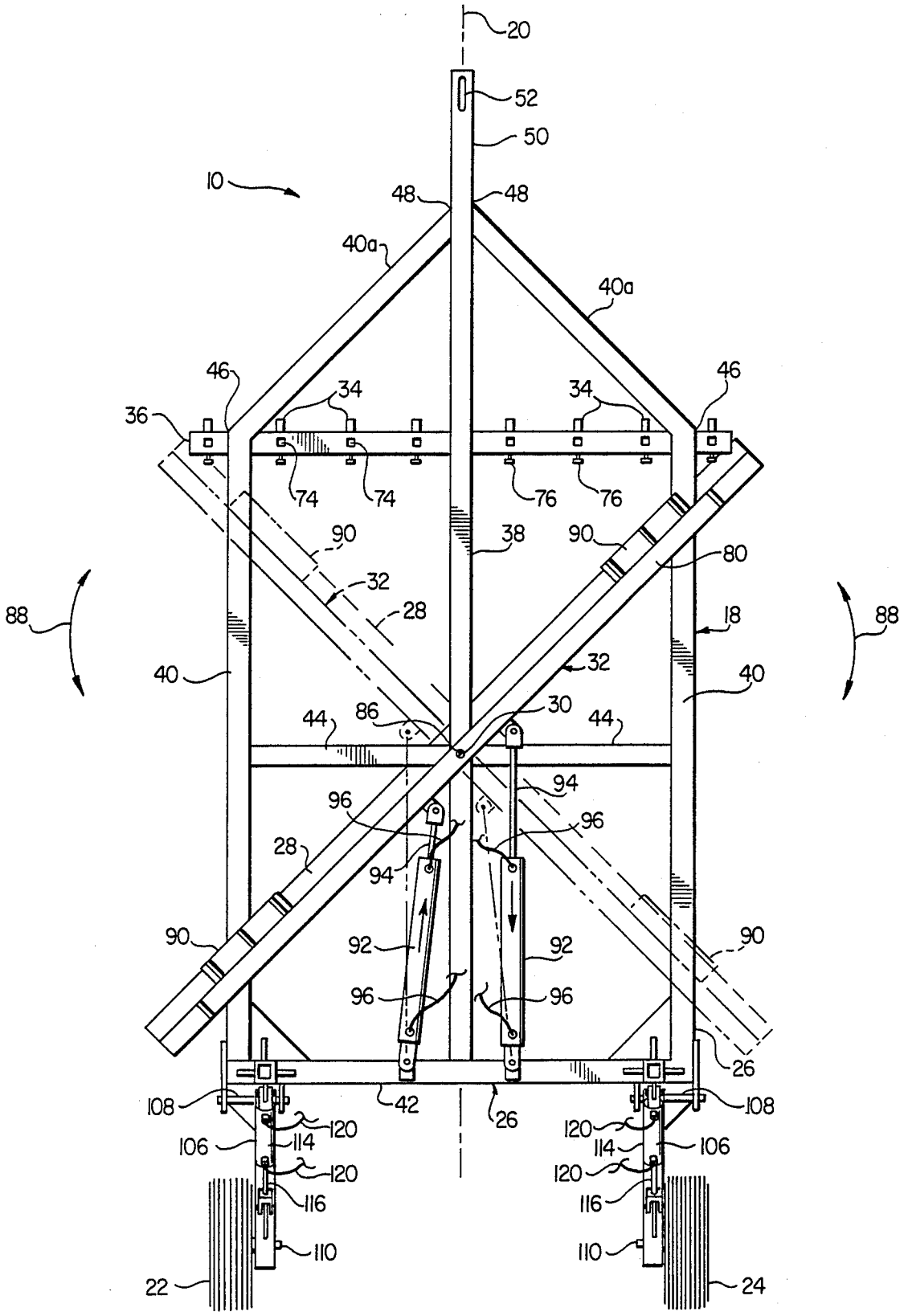
FIG. 2 is a top plan view of the scraper attachment, with certain hydraulic lines deleted for illustrative clarity, and illustrates the pivotal adjustment capabilities of its earth scraping blade.

Illustrated in FIGS. 1 and 2 is an earth scraping attachment 10 which is connected in a manner subsequently described to a conventional, vertically adjustable three point hitch 12 disposed at the rear end of an ordinary farm tractor 14 or other suitable vehicle adapted to pull the attachment 10 along the surface of the earth 16. As will be seen, the attachment 10 is uniquely adjustable in a variety of manners such that it is provided, in many regards, with the earth working usefulness and flexibility of a considerably more complex and expensive and commercial motor grader. The attachment 10 is, however, considerably more maneuverable than the conventional motor grader and is better suited to grading and scraping operations in confined areas such as along fencerows or the like. Additionally, when a particular earth scraping operation is completed, the attachment 10 may be easily and quickly disconnected from the tractor 14 to free the tractor for other conventional uses thereof.

The attachment 10 basically includes an elongated frame 18 which extends longitudinally along a generally horizontally disposed central axis 20, and a pair of frame support wheels 22 and 24 positioned on opposite sides of the axis 20 and operatively connected to a rear end portion 26 of the frame. An elongated earth scraping blade 28 is positioned beneath a longitudinally intermediate portion of the frame and is supported thereon for adjustable pivotal motion about a generally vertically extending axis 30 by an elongated blade support structure 32. A spaced series of downwardly extending earth ripping teeth 34 are removably connected to an elongated, transversely extending tooth support member 36 secured to the underside of the frame forwardly of the blade 28.

As the attachment 10, in one of its many operative "down" positions, is forwardly pulled along the earth 16 by the tractor 14, the teeth 34 rip furrows in the earth to loosen it, and the following scraping blade 28 is drawn through the loosened earth to scrape and grade it. In a simple and quite inexpensive manner subsequently described, the height of the frame 18 relative to the earth, its forward-to-rear angular orientation, and its side-to-side pivotal orientation relative to the axis 20 may be selectively and independently adjusted to uniquely provide the pivotally mounted blade 28, and the ripping teeth 34, with a wide variety of operating orientations relative to the earth. Importantly, this positional flexibility as to the scraping blade and the ripping teeth is achieved without the conventional expense and mechanical complexity involved in providing a system for raising and lowering the blade and teeth relative to the frame. Except for the pivotal mounting of the blade to the frame, the positions of the scraping blade and the ripping teeth are otherwise fixed relative to the frame.

With particular reference now to FIG. 2, the frame 18 is formed from several hollow metal members of rectangular cross-section which are welded or otherwise intersecured to define the overall frame. Such members include an elongated central frame member 38 which extends along the axis 20 and is flanked on opposite sides of the axis by a pair of elongated side frame members 40. The rear ends of the frame members 38 and 40 are intersecured by a transversely extending rear cross member 42, while longitudinally intermediate portions of the frame members 38 and 40 are intersecured by a pair of transversely extending central cross members 44. Forward end portions $40_a$ of the side frame members 40 are bent at points 46 toward the central frame member 38 and are secured at their forward ends to the frame member 38 at points 48. A forward end or tongue portion 50 of the central frame member 38 projects forwardly beyond the connection points 48 and has a suitable depending socket fitting 52 positioned beneath its outer end.

As is best illustrated in FIGS. 1, 7, 7A and 7B, the three point hitch 12, which is of conventional construction, comprises a laterally spaced pair of rearwardly projecting lower support arms 54 which are pivotally connected at their inner ends to a suitable portion of the tractor structure such as its transmission housing 56. These lower support arms 54 are rotatable about their inner end pivot points by a pair of hydraulically driven actuating arms 58 interconnected between the support arms 54 and a suitable drive mechanism (not illustrated). Hitch 12 also includes an upper central support arm 60 which is positioned above and laterally between the lower support arms 54. The inner end of the upper support arm 60 is pivotally connected to the transmission housing 56.

To removably connect the tongue portion 50 of the frame 18 to the three point hitch 12, a specially designed hitch connection member 62 is provided. The connection member 62 has a generally triangular configuration defined by a horizontally extending base member 64 and a pair of upwardly and inwardly sloping side members 66 which are secured at their lower ends to the outer ends of the base member 64. The outer ends of the lower hitch support arms 54 are pivotally connected to lower corner portions of the hitch connection member 62. Formed at the upper corner of the triangular hitch connection member 62 is a clevis 68 which receives the outer end of the upper hitch support arm 60 and is pivotally connected thereto by a retaining pin 70. A hitch ball 72 is secured to a central portion of the base member 64 and is received within the frame tongue socket 52.

It can be seen that by appropriately moving the actuating arms 58 of the hitch 12 to cause corresponding pivoting of the hitch support arms 54 and 60, the hitch connection member 62 may be selectively raised or lowered. Such raising or lowering of the hitch connection member correspondingly raises or lowers the frame tongue portion 50 to cause the frame 18 to pivot about its rear support wheels 22 and 24. As will be subsequently discussed in greater detail, this in turn provides a first mode of raising or lowering the scraper blade 28 and the ripper teeth 34 relative to the earth 16.

The elongated tooth support member 36 (FIGS. 1 and 2) has a vertically elongated rectangular cross-section, and extends transversely across and is welded to the underside of the frame 18 adjacent the bend points 46 of the side frame members 40. Extending upwardly through the underside of the tooth support member 36 are a longitudinally spaced series of socket openings 74 which receive the elongated upper ends of the ripper teeth 34. These upper end portions of the teeth 34 are removably retained within the sockets 74 by means of locking pins 76. The downwardly extending ripper teeth 34 function to engage and rip the earth 16 as the attachment 10 is pulled forwardly by the tractor to facilitate the scraping operation of the blade 28 which is subsequently drawn across and through the ripped earth section.

Figure 5:
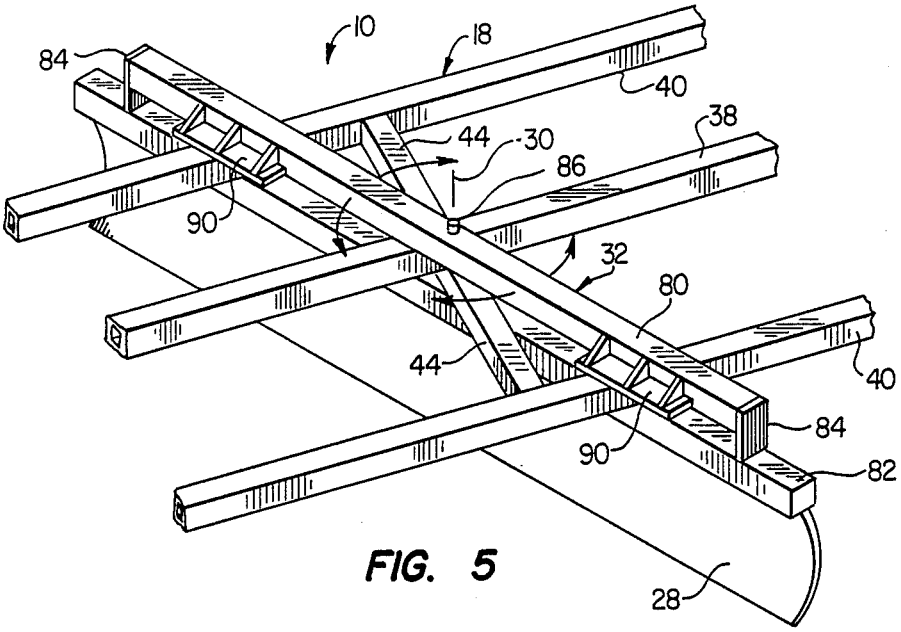
FIG. 5 is a front perspective view of a portion of the scraper attachment illustrating its pivotal scraper blade attachment structure.

Referring now to FIGS. 2 and 5, the blade support structure 32 comprises an elongated upper support arm member 80 which rests upon the upper surface of the frame 18, and a somewhat longer lower support arm member 82 which extends along the underside of the frame. At the outer ends of the upper support arm member 80 are downturned tab portions 84which are welded to the lower support arm member 82 so that the intersecured support arm members 80, 82 vertically straddle the frame 18 as best illustrated in FIG. 5. The scraper blade 28 is secured to and depends from the underside of the lower support arm member 82, and has opposite end portions which project laterally outwardly of the side frame members 40. With the frame 18 in a horizontal orientation, the lower ends of the teeth 34 are generally level with the lower edge of the scraping blade 28.

The support structure 32, and the scraper blade 28 which it carries, are connected to the frame 18 for pivotal movement relative thereto about the generally vertically extending axis 30 by means of a pivot pin 86 which projects upwardly from the central frame member 38 at its juncture with the central cross members 44 and is received in a corresponding circular hole formed through a longitudinally central portion of the upper support arm member 80. This permits the support structure 32 and the scraper blade 28 to be rotated about the axis 30 to a multiplicity of pivotally adjusted positions representatively illustrated in FIG. 2 by the dotted line positions of the support structure 32 and the blade 28 and the double ended arrows 88. It can be seen that during pivotal motion of the support structure 32 relative to the frame 18, outer end portions of the upper support arm member 80 slide along the upper surfaces of the side frame members 40. To distribute over a greater surface area the weight load of the blade and blade support structure borne by the upper surfaces of the members 40, metal bearing pads 90 are welded to the opposite end portions of the upper support arm member 80 for engagement with the upper surfaces of the side frame members 40.

The support frame structure 32 may be automatically pivoted to a desired position relative to the frame 18, and locked in the pivotally adjusted position, by means of a pair of hydraulic cylinders 92 (FIGS. 1 and 2)

pivotally connected at ends thereof to the rear frame cross member 42 on opposite sides of the central frame member 38. Each of the cylinders 92 has an extendable and retractable actuating rod 94 which is pivotally connected at its outer end to the upper support arm member 80 as illustrated.

As is conventional, the tractor 14 is provided with an hydraulic drive system which has two or more auxiliary supply outlets and an hydraulic return reservoir. To operate the cylinders 92, hydraulic lines 96 are appropriately interconnected between the cylinders 92 and the auxiliary drive portion 95 (FIG. 1) of this hydraulic system. It can be seen in FIG. 2 that by appropriately extending one of the actuating rods 94, and retracting the other one, the support structure 32 can be pivoted a predetermined degree in a selected direction about the axis 30 and hydraulically locked in a pivotally adjusted position relative to the frame 18. Hydraulic lines 96 may be conveniently supported on suitable support members 98 mounted on the control frame member 38.

Figure 3:
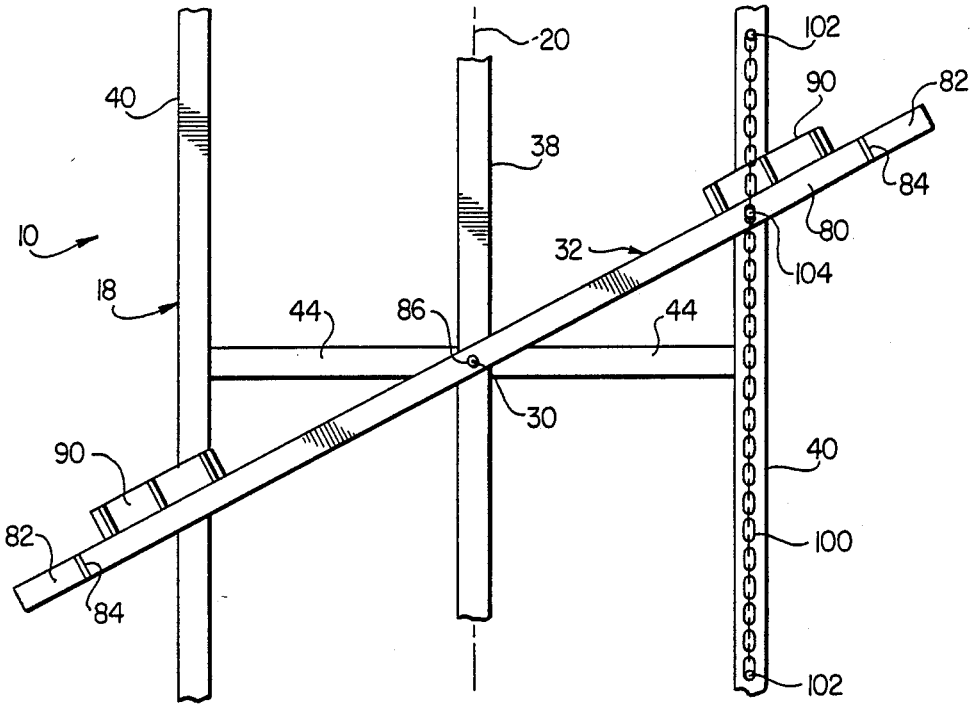
FIG. 3 is a fragmentary top plan view of the scraper attachment and illustrates an alternate method of locking the scraper blade in a pivotally adjusted position.

Instead of hydraulically adjusting the pivotal orientation of the scraper blade 28 in this manner, the blade may also be manually pivoted about the vertical axis 30 and manually locked in a pivotally adjusted position. A representative method of manually locking the support structure 36 and the scraper blade 28 in a pivotally adjusted position is illustrated in FIG. 3. A chain 100 is extended along the upper surface of one of the side frame members 40 and is passed over the upper support arm member 80 and one of its associated bearing pads 90. The opposite ends of the chain 100 are connected to hook members 102 secured to the illustrated side frame member 40 so that the upper support arm member 80 may be moved beneath the chain. When the support structure 36 is pivoted to a desired position, an upwardly projecting pin member 104 secured to the upper support arm member 80 is inserted into one of the chain links directly above it, the inserted pin 104 functioning to prevent pivoting in either direction of the support structure 36.

Figure 4:
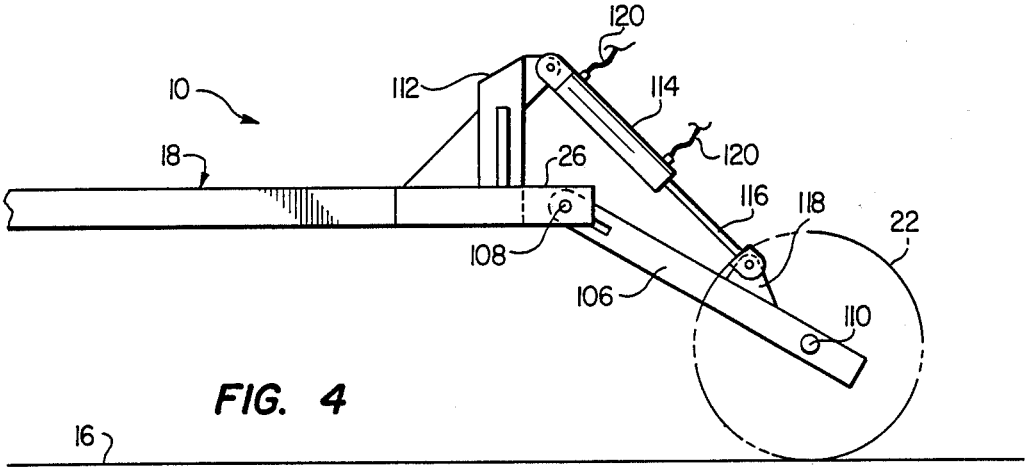
FIGS. 4 and 4A are schematic side elevational views of a rear portion of the scraper attachment and illustrate, in two representative wheel positions, the operation of a mechanism by which the heights of a pair of rear frame support wheels may be selectively and independently adjusted.
Figure 4A:
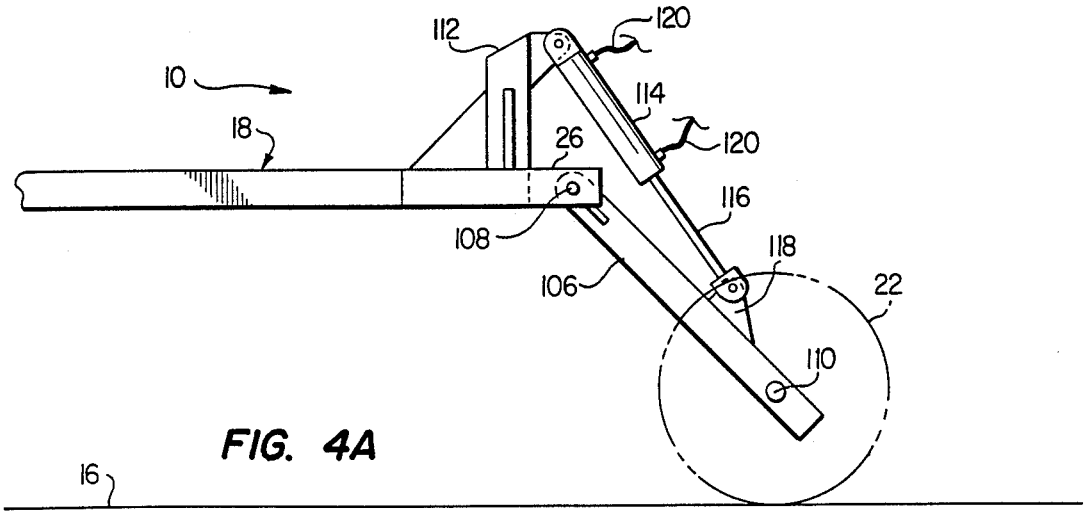
Figure 6:
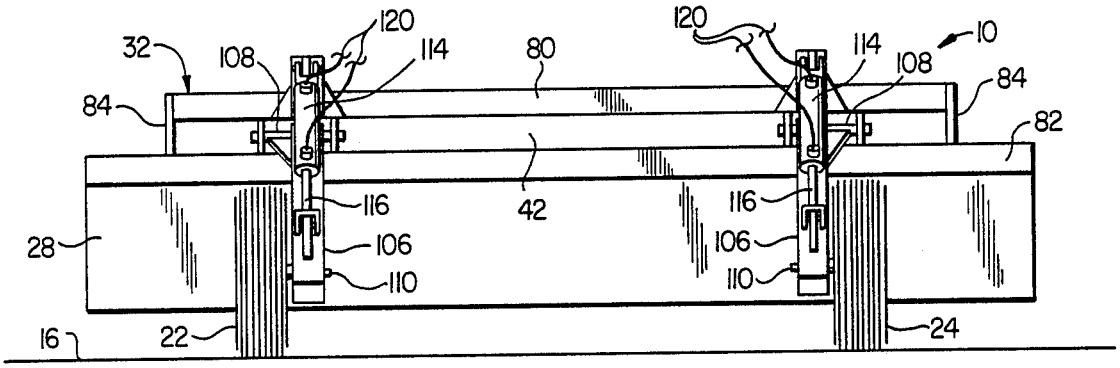
FIGS. 6 and 6A are rear elevational views of the scraper attachment and respectively illustrate the attachment with its rear support wheels adjusted to the same height and adjusted to different relative heights.

Referring now to FIGS. 4, 4A and 6, according to an important aspect of the present invention, the rear frame support wheels 22 and 24 are selectively and independently adjustable to vary their heights relative to the frame 18. As will be seen, by adjusting the wheels so that one is higher than the other relative to the frame, the scraper blade 28 may be caused to tilt from end to end to thereby scrape the earth at a horizontally inclined angle.

To connect the wheels 22, 24 to the frame 18, the inner ends of a pair of elongated wheel support arms 106 are pivotally connected to opposite rear corner portions of the frame 18 by means of pivot pins 108, while the outer ends of the arms 106 are rotatably connected to short axle members 110 secured to the support wheels 22 and 24. Welded to the opposite rear corners of the frame 18 are a pair of upwardly projecting mounting members 112 having upper ends to which the inner ends of a pair of hydraulic cylinders 114 are pivotally connected. The cylinders 114 are provided with extendable and retractable actuating rods 116 whose outer ends are pivotally connected to a pair of upwardly projecting connecting members 118 secured to longitudinally intermediate portions of the wheel support arms 106. The cylinders 114 are operatively connected to the previously mentioned auxiliary hydraulic drive system 95 of the tractor 14 by suitable hydraulic supply and return lines 120 carried by the support members 98.

With reference to FIGS. 4 and 4A, which schematically illustrate the support wheel 22 and its associated hydraulic cylinder 114 and wheel support arm 106, it can be seen that by extending the actuating rod 116 the wheel support arm 106 is caused to pivot in a clockwise direction (as in FIG. 4A) about its pivot pin 108 to thereby cause a lowering of the wheel 22 relative to the frame 18, and a raising of the left rear corner of the frame. Correspondingly, a retraction of the actuating arm 116 (FIG. 4) causes a counterclockwise pivoting of the support arm 106 about the pivot pin 108 to raise the wheel 22 relative to the frame, and lower the left rear corner of the frame. This selective wheel raising and lowering process may, of course, may be independently carried out in conjunction with the opposite support wheel 24.

Figure 6A:
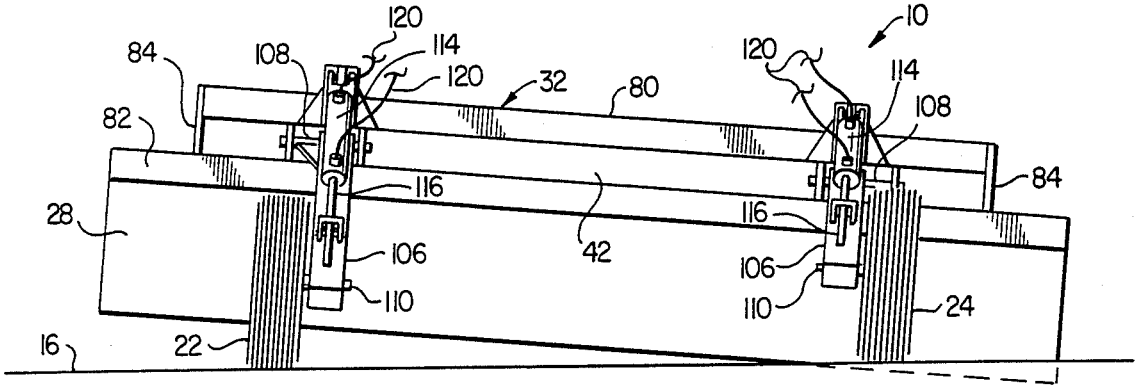

This ability to individually control the height of each of the wheels 22, 24 relative to the frame 18 permits the wheels to be adjusted to mutually different heights relative to the frame to thereby tilt the frame in a side-to-side manner about its central longitudinal axis 20 to concomitantly cause an end-to-end tilting of the scraper blade 28 as depicted in FIG. 6A. As the tilted blade 28 is drawn along the earth 16 it produces a correspondingly angled scraping pattern along the earth. Additionally, of course, the wheels 22, 24 may be raised or lowered to the same height relative to the frame to raise or lower the rear end portion of the frame relative to its tongue portion. This correspondingly raises or lowers the scraper blade and the ripper teeth while maintaining the blade and teeth in an essentially horizontally disposed orientation as depicted in FIG. 6. It can be seen that the wheel adjustment mechanism of the present invention provides two additional frame adjustment modes which are independent of the first mode (vertically adjusting the frame tongue)—namely, a vertical adjustment of the rear end of the frame and a pivotal adjustment of the frame about its central axis 20.

Figure 7:
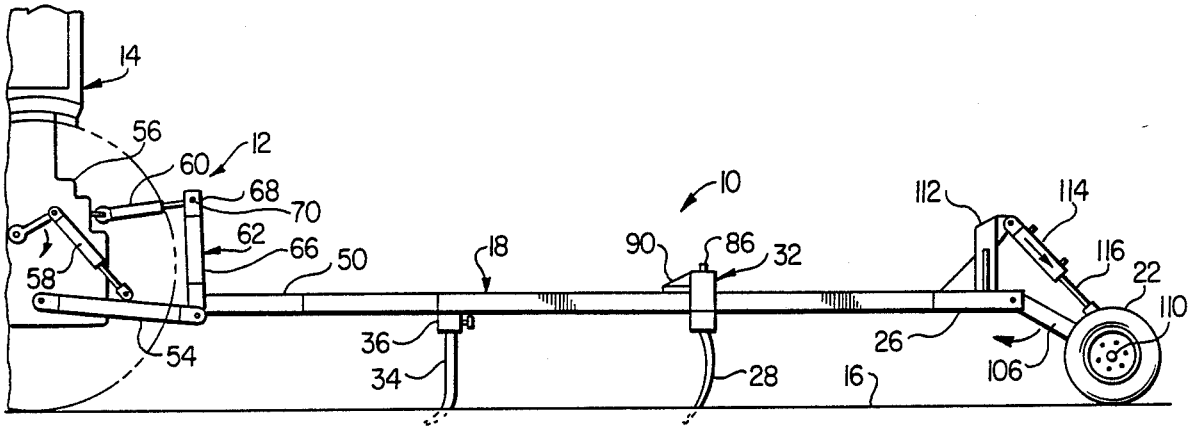
FIGS. 7, 7A and 7B are schematic side elevational views of the scraper attachment, and a portion of the tractor, and illustrate various height adjustments which can be made to the attachment.
Figure 7A:
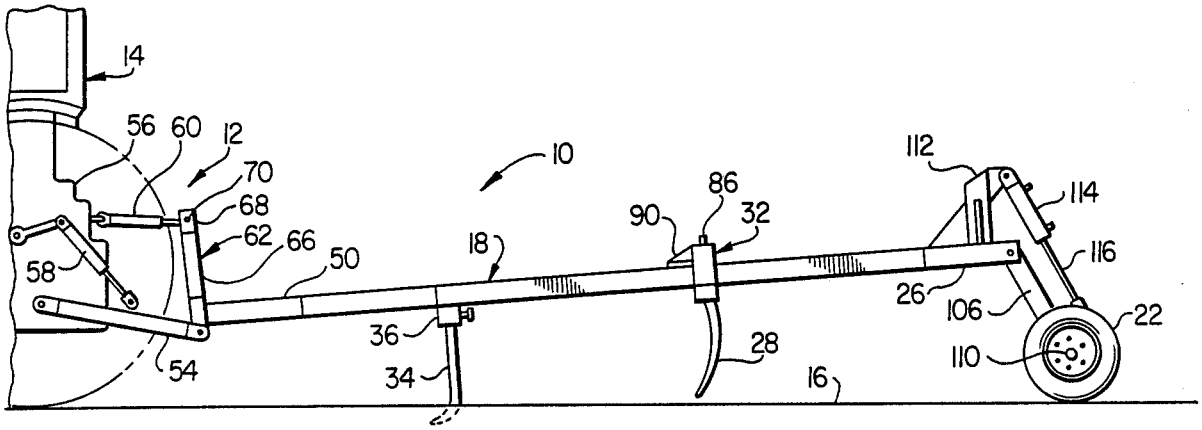
Figure 7B:
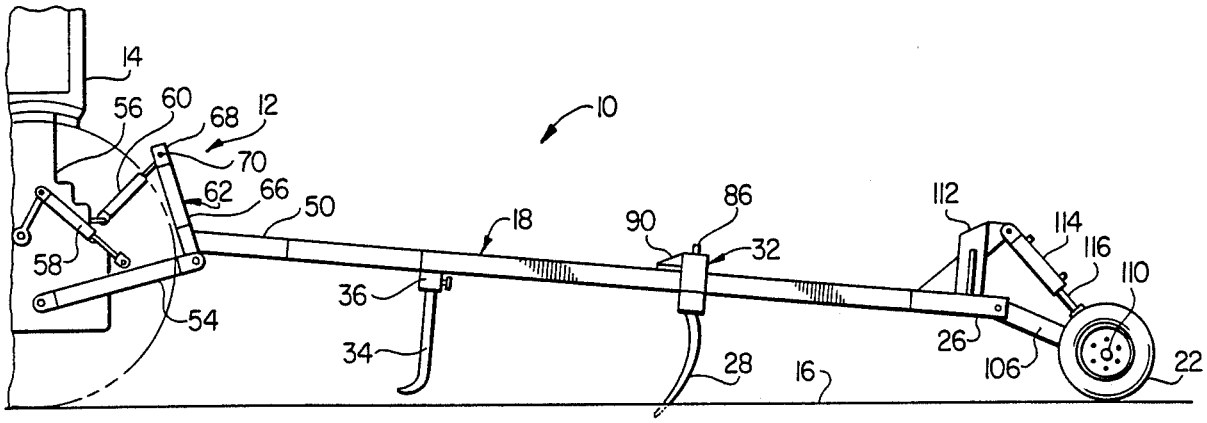

Referring now to FIGS. 7, 7A and 7B, the independent wheel height adjustment mechanism described above may be utilized independently of or in conjunction with the vertical adjustment capabilities of the three point hitch 12 to selectively alter the height of the frame 18 and/or its forward-to-rear inclination angle. For example, as depicted in FIG. 7, the entire frame 18 may be selectively raised or lowered while being kept in an essentially horizontal orientation to thereby selectively vary the cutting depths of the blade 28 and the teeth 34 and generally equalize such cutting depths. Or, by raising the frame 18 sufficiently, both the ripping teeth and the scraping blade can be lifted above the earth when the attachment 10 is being moved to or away from a work site.

By lowering the frame tongue 50 relative to the rear end 26 of the frame 18 the cutting depth of the ripping teeth 34 may be increased relative to the cutting depth of the scraping blade 28 as depicted in FIG. 7A. Also, if desired, by further raising the forwardly tilted frame 18 depicted in FIG. 7A the scraping blade 28 maybe raised above the earth 16 so that only the cutting teeth 34 are operative.

In a similar manner, a downward tilting of the rear end 26 of the frame 18 can be used to increase the scraping depth of the blade 28 relative to the ripping depth of the teeth 34, or to raise the teeth 34 above the earth so that only the scraping blade 28 is operative.

All of the various combinations of frame height adjustments illustrated in FIGS. 7, 7A and 7B may, of course, be effected with the frame in a side-to-side level position as illustrated in FIG. 6, or with the frame in a side-to-side tilted orientation as depicted in FIG. 6A.

It can be seen from the foregoing that the earth scraper attachment 10 of the present invention can be utilized to perform most of the earth scraping and grading functions of considerably more expensive and complicated commercial grading and scraping apparatus such as the typical motor grader. The substantial reduction in cost and complexity incorporated in the attachment 10 permits it to be used in a wide variety of farm and other domestic applications in which the use of a commercial motor grader would simply not be feasible due to cost considerations and space limitations.

The attachment 10, as previously mentioned, is easily and quickly connectable to the three point hitch of a conventional farm tractor by means of the specially designed hitch connection member 62. Prior to the connection of the attachment 10 to the tractor's hitch, the ripping teeth and/or scraping blade portions of the attachment rest upon the ground to support the tongue 50 in an elevated position Accordingly, the tractor can be simply backed toward the attachment frame tongue until the hitch ball 72 is positioned directly beneath the tongue socket 52. The hitch may then be raised to insert the ball into the socket and raise the tongue sufficiently to move the ripping teeth and the scraping blade to their "off-road" positions for transport of the attachment. Similarly, when the particular grading and scraping operation is completed, the hitch may be simply lowered to disconnect the hitch ball from the tongue socket. There is simply no need to manually lift the frame tongue onto or off of the hitch ball.

The foregoing detailed description is to be clearly understood as given by way of illustration and example only, the spirit and scope of the present invention being limited solely by the appended claims.

What is claimed is:

1. Earth scraping apparatus comprising:

a frame extending along an axis and having a forwardly disposed tongue portion connectable to a vertically adjustable section of a vehicle adapted to pull said frame, and a rearwardly disposed portion spaced apart along said axis from said forwardly disposed tongue portion;

first and second frame support wheels;

connecting means for operatively connecting said frame support wheels to said rearwardly disposed portion of said frame on opposite sides of said axis;

wheel height adjustment means for selectively and independently adjusting the height of each of said frame support wheels relative to said frame;

earth scraping means, extending below said frame, for scraping the earth as said frame is moved by said vehicle;

pivotal adjustment means for adjustably pivoting said earth scraping means relative to said frame about a generally vertically extending axis; and means for securing said tongue portion to said vertically adjustable section of the vehicle, whereby:

the cutting depth of said earth scraping means may be selectively varied, without appreciably altering their vertical earth attack angle, by appropriately raising or lowering both of said vertically adjustable vehicle section and said first and second frame support wheels without appreciably varying the vertical inclination angle of said frame axis relative to the earth, the vertical earth attack angle of said earth scraping means may be selectively varied by vertically tilting said frame axis using either of said vertically adjustable vehicle section and said wheel height adjustment means, the horizontal earth attack angle of said earth scraping means may be selectively varied utilizing said pivotal adjustment means, and the earth scraping means may be selectively tilted about an axis generally parallel to said frame axis by utilizing said wheel height adjustment means to differentially adjust the height of said first and second frame support wheels relative to said frame, said earth scraping means including an elongated earth scraping blade disposed beneath said frame between said forwardly and rearwardly disposed portions thereof, and a blade support structure pivotally connected to said frame for rotation relative thereto about a generally vertically extending axis, said blade support structure being secured to said earth scraping blade, said blade support structure being manually pivotable relative to said frame, said pivotal adjustment means including locking means for manually locking said blade support structure in a selected manually pivoted position, and said locking means including a chain secured to said frame, and a locking member carried by said blade support structure and insertable into a selected one of the links of said claim.

2. Earth scraping apparatus comprising:

a frame extending along an axis and having a forwardly disposed portion connectable to a vertically adjustable section of vehicle adapted to pull said frame, and a rearwardly disposed portion spaced apart along said axis from said forwardly disposed portion;

first and second frame support wheels;

connecting means for operatively connecting said frame support wheels to said rearwardly disposed portion of said frame on opposite sides of said axis;

wheel height adjustment means for selectively and independently adjusting the height of each of said frame support wheels relative to said frame;

earth scraping means, extending below said frame, for scraping the earth as said frame is moved by said vehicle; and pivotal adjustment means for adjustably pivoting said earth scraping means relative to said frame about a generally vertically extending axis, said earth scraping means including an elongated earth scraping blade disposed beneath said frame between said forwardly and rearwardly disposed portions thereof, and a blade support structure pivotally connected to said frame for rotation relative thereto about a generally vertically extending axis, said blade support structure being secured to said earth scraping blade, said blade support structure being manually pivotable relative to said frame, said pivotal adjustment means including locking means for manually locking said blade support structure in a selected manually pivoted position, and said locking means including a chain secured to said frame, and a locking member carried by said blade support structure and insertable into a selected one of the links of said claim.

3. A towable earth scraper attachment comprising:

a generally horizontally positionable elongated frame having:

an elongated central member extending generally along the longitudinal axis of said frame, said central member having a front end portion connectable to a towing vehicle to be pulled thereby, and a rear end portion, first and second longitudinally extending side members positioned on opposite sides of said central member and spaced laterally outwardly therefrom, each of said first and second side members having front end portions secured to said front end portion of said central member, and rear end portions secured to said rear end portion of said central member at a rear end portion of said frame;

wheel means for rollingly supporting said rear end portion of said frame in an elevated position relative to the ground;

an earth scraper blade support structure including:

an elongated lower support member having a longitudinally central portion positioned beneath a longitudinally intermediate portion of said central member, and outer end portions positioned beneath said first and second side members, means for pivotally connecting said longitudinally central portion of said lower support member to said longitudinally intermediate portion of said central member, and upper support means, slidably resting atop said first and second side members and secured to said outer end portions of said lower support member, for movably supporting said outer end portions of said lower support member on said first and second side members;

scraper blade means, secured to and depending from said lower support member, for scraping the earth as said frame is pulled therealong by the towing vehicle; and means for pivotally adjusting said earth scraper blade support structure, and thus said scraper blade means, relative to said frame.

4. The towable earth scraper attachment of claim 3 wherein:

said means for pivotally adjusting said earth scraper blade support structure include hydraulic cylinder means operatively interconnected between said frame and said earth scraper blade support structure.

5. The towable earth scraper attachment of claim 3 wherein:

said towing vehicle has a vertically adjustable section, said wheel means include first and second wheel structures each pivotally mounted to said rear end portion of said frame, and said attachment further comprises hydraulic cylinder means for pivotally adjusting said first and second wheel structures to selectively and independently vary the effective heights thereof relative to said frame, and means for connecting said front end portion of said central member to said vertically adjustable section of said towing vehicle.

6. The towable earth scraper attachment of claim 3 wherein:

said towing vehicle has a vertically adjustable section, said wheel means include vertically adjustable first and second wheel structures mounted on said rear end portion of said frame on opposite sides of said longitudinal axis, and said attachment further comprises means for vertically adjusting said first and second wheel structures to selectively and independently vary the effective heights thereof relative to said frame, and means for connecting said front end portion of said central member to said vertically adjustable section of said towing vehicle, whereby:

the cutting depth of said scraper blade means may be selectively varied, without appreciably altering their vertical earth attack angle, by appropriately raising or lowering both of said vertically adjustable vehicle section and said first and second wheel structures without appreciably varying the vertical inclination angle of said frame axis relative to the earth, the vertical earth attack angle of said scraper blade means may be selectively varied by vertically tilting said frame axis using either of said vertically adjustable vehicle section and said means for vertically adjusting said first and second wheel structures, the horizontal earth attack angle of said scraper blade means may be selectively varied utilizing said means for pivotally adjusting said earth scraper blade support structure, and the scraper blade means may be selectively tilted about an axis generally parallel to said frame axis by utilizing said means for vertically adjusting said first and second wheel structures to differentially adjust the height of said first and second wheel structures relative to said frame.

* * * * *